US007089969B2

(12) United States Patent
Jackson et al.

(10) Patent No.: US 7,089,969 B2
(45) Date of Patent: Aug. 15, 2006

(54) BRICK MASON WIRE BEND

(75) Inventors: James Edward Jackson, Chicago, IL (US); Julius Michael Jackson, 233 E. 47th St., Chicago, IL (US) 60653; Kimberly Lenora Mitchell Jackson, Chicago, IL (US); Anne Nathan Jackson John, Chicago, IL (US); André Adam Jackson, Chicago, IL (US)

(73) Assignees: Julius Michael Jackson, Chicago, IL (US); Anne Nathan Jackson, Chicago, IL (US); Kimberly Lenora Mitchell, Chicago, IL (US); André Adams, Chicago, IL (US)

( * ) Notice: Subject to any disclaimer, the term of this patent is extended or adjusted under 35 U.S.C. 154(b) by 436 days.

(21) Appl. No.: 10/439,381

(22) Filed: May 19, 2003

(65) Prior Publication Data

US 2004/0231746 A1 Nov. 25, 2004

(51) Int. Cl.
*B21F 1/00* (2006.01)

(52) U.S. Cl. ..... 140/106; 140/123

(58) Field of Classification Search ..... 140/52, 140/56, 57, 106, 123; 72/458, 479
See application file for complete search history.

(56) References Cited

U.S. PATENT DOCUMENTS 1,531,001 A * 3/1925 Graves ..... 72/458
1,736,585 A * 11/1929 Fehlhaber ..... 140/117
3,965,720 A * 6/1976 Goodwin et al. ..... 72/458

* cited by examiner

*Primary Examiner*—Lowell A. Larson

(57) ABSTRACT

A Brick Mason Wire Bend tool for use of adjusting the tie wire in masonry construction has the form of a bar having an intermediate bent radius section and opposite end portions which are displaced out of the plane of the intermediate section at an acute angle. The working end portion has four jaws and four slots perpendicular to the longitudinal axis. The opposite end is curved and beveled and coated with a poly-carbonate coating. At the base of the central radius on opposite sides are two holes of equal distance and diameter. It is hand tooled, cold bend construction and galvanized.

2 Claims, 3 Drawing Sheets

BRICK MASON WIRE BEND

FEDERALLY SPONSORED RESEARCH

Not Applicable

SEQUENCE LISTING OR PROGRAM

Not Applicable

BACKGROUND OF THE INVENTION

Field of Invention

This invention relates to tie wire used for the stabilization in masonry construction, specifically for the use of bending support wire: Ladder Tie Wire, Rectangular Tie Wire, Truss Tie Wire and the Z Tie Wire.

BACKGROUND OF THE INVENTION

Prior Art

The closest prior art of which we are aware of in the same physical aspect is the "Fence Tool" & in the same working capacity is the "Bending Tool". The previous tool, the Fence Tool, U.S. Pat. No. 1,531,001, and dated May 29, 1922 had appearance similarities to the tool of the present invention in that it also included end portions with slots therein for grasping fence wire but, was dissimilar in a few respects. 1) The working portions of the present invention are specifically located at one end of the tool & the working part of the Fence Tool is on both ends. 2) The dimensions of the present invention includes: an intermediate bent radius section which is designed for the correct function of the device. The Fence Tool is used for the connection with the proper installation of fencing or fence wires on posts, therefore it is not used in the same working capacity as the Brick Mason Wire Bend.

The Bending Tool, U.S. Pat. No. 1,736,585, and dated Jul. 31, 1928 have the purpose of carrying out clip bending operations. Even though this is a tool used in construction it is not specifically designed to carry out the functions of bending tire wire, truss wire, ladder wire, z-tie wire, & rectangular wire.

BACKGROUND OF INVENTION

Objects and Advantages

Accordingly, besides the objects and advantages of the wire bender described in the above patent, several objects and advantages of the present invention are:

a) different gauges on the jaws in order to use on different brick mason wires;
b) the device is a hand tool which will be more durable than the stamp (heated) device because of the durability of the end product;
c) easy storage and lightweight;
d) left hand or right hand accessibility;
e) the 180° bend was built for the user to obtain better leverage in the working capacity;
f) made out of galvanized steel for durability;
g) poly-carbonate coating handle for a better grip and visibility.

In conclusion the present invention is designed for the soul purpose of manipulation of tie wire and designed specifically so to prevent damage to other tools used not specifically for that same purpose.

SUMMARY OF THE INVENTION

In accordance with the invention the device of a hand tool, having a cold bend application with working portions of the device with two jaws on either sides at one end perpendicular to the longitude and adjacent to one another and consisting of an intermediate bent radius section.

DRAWING

Figures

Figure 1:
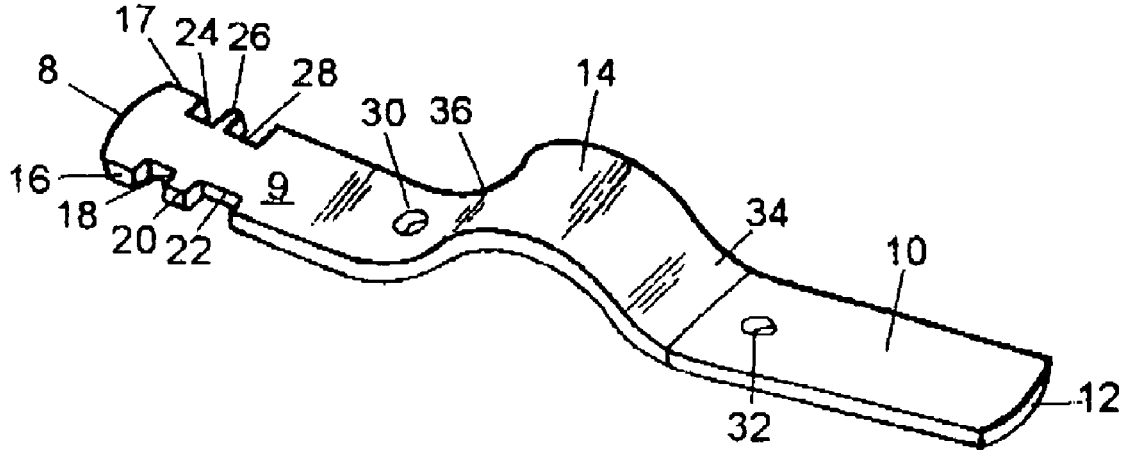
FIG. 1 is an isometric view of the tool according to the invention.

| DRAWINGS--Reference Numerals | |
|---|---|
| 8 | Beveled Edge |
| 9 | Working End Portion |
| 10 | Poly-Carbonate Coated Handle |
| 12 | Beveled Edge |
| 14 | Intermediate Bent Radius |
| 16 | Outer Jaw |
| 17 | Outer Jaw |
| 18 | Outer Slot |
| 20 | Inner Jaw |
| 22 | Inner Slot |
| 24 | Outer Slot |
| 26 | Inner Jaw |
| 28 | Inner Slot |
| 30 | Hole |
| 32 | Hole |
| 34 | Leverage |
| 36 | Leverage |
| 50 | Tie Wire |
| 51 | Adjusted Tie Wire |
| 52 | Block Wall |
| 54 | Brick Wall |

DETAILED DESCRIPTION

FIG. 1

Preferred Embodiment

Referring to FIG. 1, the tool of the invention comprises a bar having an intermediate bent radius section 14 and opposite end portions 9 and 10 which are displaced out of the plane of the intermediate section 14 at an acute angle. The working end portion 9 has four jaws perpendicular to the longitudinal axis with outer jaw 17 and inner jaw 26 projecting in one direction while outer jaw 16 and inner jaw 20 are projecting in opposite directions. Working end portion 9 comprises four slots: slots 24 and 18 are perpendicular to outer jaws 16 and 17 inner slots 22 and 28 are perpendicular to inner jaws 20 and 26. Before and after intermediate bent radius section 14 two holes 30 and 32 are equal distance and equal diameter from the base of the intermediate bent radius section 14. At the base of the intermediate bent radius section 14 are leverages 34 and 36 which are at an acute angle of 3° degrees out of the longitudinal plane of the base. Working end portion 9 has a beveled edge 8. End portion 10 has a beveled edge 12 that is uniform to the composition of the material and is opposite of working end portion 9. End portion 10 is laminated with a poly-carbonate coating for identification and a cushion for a firm grip.

Both the material of which the two is made and the manner in which it is formed are important to attain a successful tool. The material is made of ASTM A36 galvanized steel with a thickness of 3/16 inch and a width of 1¼ inch. Even though the tool can be developed through machine process this device was hand tooled, cold bend and poly-carbonate coated on one end.

The physical properties of the tool, according to the invention which performs satisfactorily, include a tensile min (ksi) 58/80; a held min (ksi) 36; inside bend radius 90° degrees 1½ t transverse.

FIG. 2

Figure 2:
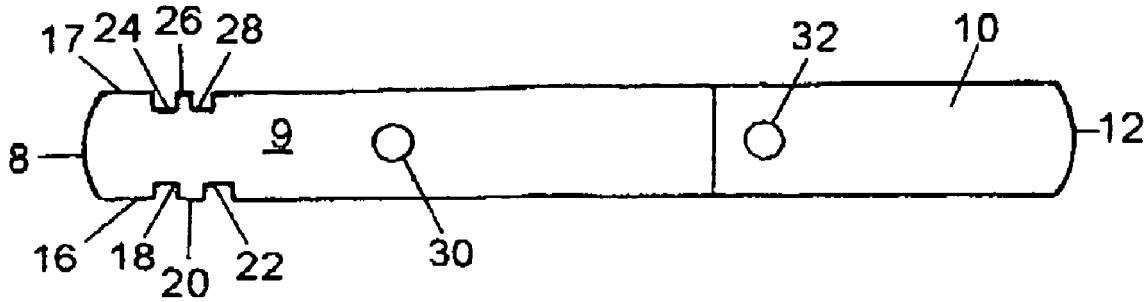
FIG. 2 is a plan view of the tool according to the invention.

FIG. 2 is a plan view of the tool according to the invention as described in FIG. 1.

FIG. 3

Figure 3:
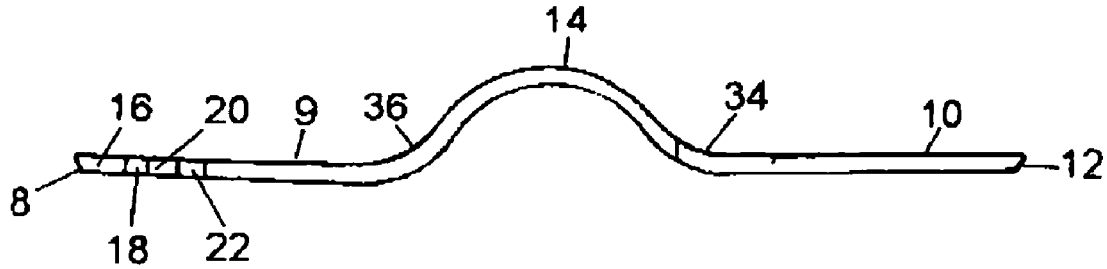
FIG. 3 is a front elevation of the tool according to the invention.

FIG. 3 is an elevation view of the tool according to the invention as described in FIG. 1.

OPERATION

Figure 4:
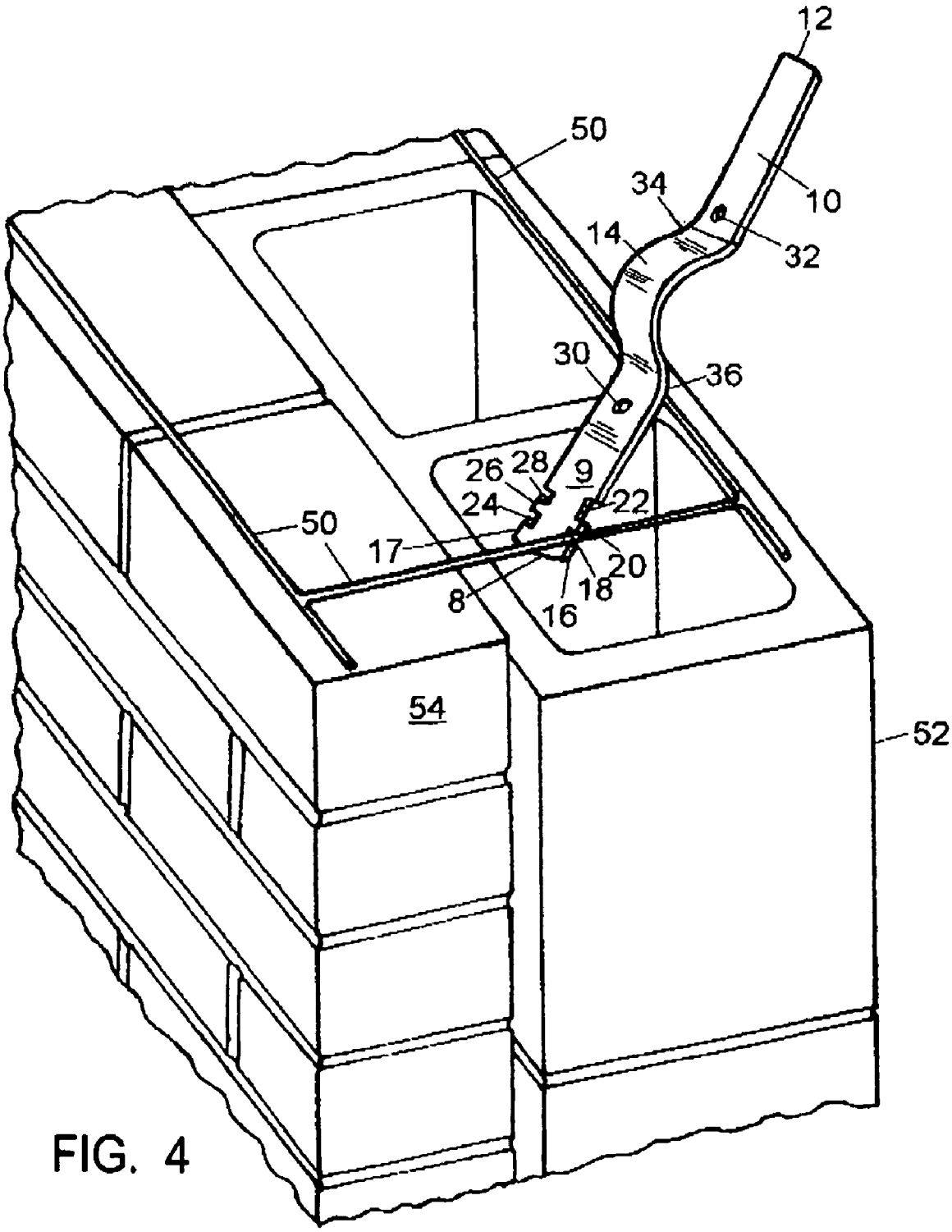
FIG. 4 is a perspective view illustrating the use of the tool prior to the adjustments of the tie wire.
Figure 5:
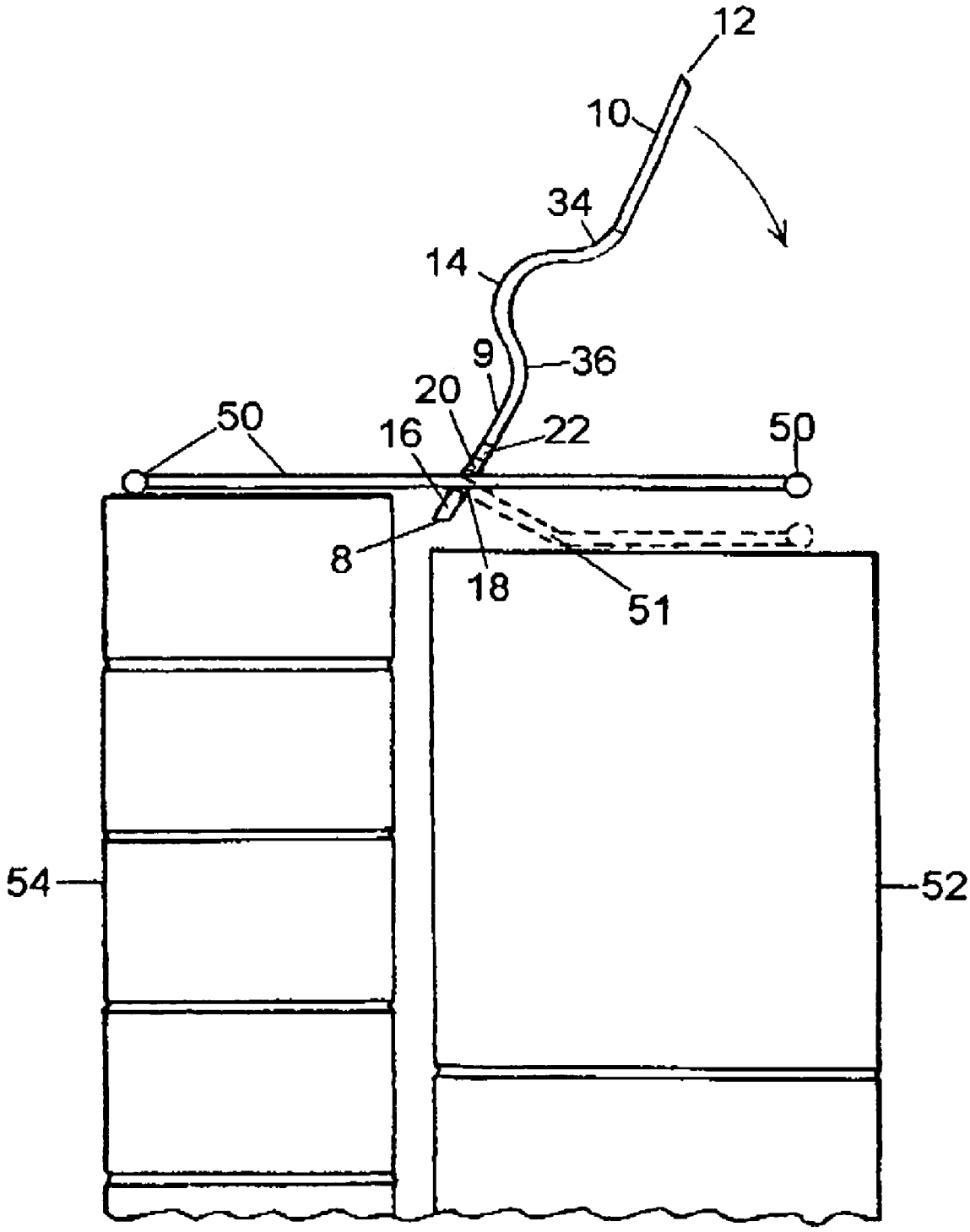
FIG. 5 is an elevation view of a masonry wall unit illustrating the use of the tool bending the tie wire to the desired position.

FIGS. 4 and 5

The tool is used in a manner illustrated in FIGS. 4 and 5 to adjust tie wire 50 between brick 54 and block 52 walls when either the brick 54 or block 52 is misaligned. The manner illustrated in FIG. 4 shows the tool in the process of engagement stabilizing the tie wire 50 with the use of the working end portion 9 where the slot 18 is in pre-engagement. FIG. 5 illustrates the tool at work being used to adjust tie wire 50 at the point of intersection as shown in FIG. 4. Where slot 18 engages tie wire 50 is bent down according to the angle necessary to tie the brick wall 54 to the block wall 52 by angling handle 10 to desired angle. Reference number 51 is the desired position of the tie wire after the adjustment. All other reference numbers refers to FIG. 1.

What is claimed is:

1. A hand tool for bending stabilizer wires used in brick masonry construction comprising a substantially rectangular tool body of uniform thickness having a working end portion and a handle end portion, the end portions being substantially co-planar and defining a longitudinal axis, the body having an intermediate bent radius section integrally connecting the end portions, the working end portion having opposite side edges parallel to the longitudinal axis and jaws disposed along the side edges, the jaws being defined by slots of different width dimensions extending inwardly from the side edges substantially perpendicular to the longitudinal axis, whereby the jaws are adapted to engage a stabilizer wire and bend it upon rotation of the tool body.

2. The tool of claim 1 wherein respective jaws have different widths in the direction of the longitudinal axis.

* * * * *